United States Patent [19]

Meylan

[11] Patent Number: 5,051,061

[45] Date of Patent: Sep. 24, 1991

[54] MULTI-CYLINDER STEAM TURBINE SET

[75] Inventor: Pierre Meylan, Neuenhof, Switzerland

[73] Assignee: Asea Brown Boveri Ltd., Baden, Switzerland

[21] Appl. No.: 446,688

[22] Filed: Dec. 6, 1989

[30] Foreign Application Priority Data

Dec. 23, 1988 [CH] Switzerland ..... 4780/88

[51] Int. Cl.[5] ..... F01D 3/00

[52] U.S. Cl. ..... 415/104; 415/126; 248/901

[58] Field of Search ..... 415/66, 67, 104, 126, 415/134; 248/901, 584

[56] References Cited

U.S. PATENT DOCUMENTS

| | | | |
|---|---|---|---|
| 986,635 | 3/1911 | Kirk | 415/104 |
| 1,416,760 | 5/1922 | Steenstrup | 248/678 |
| 1,684,082 | 9/1928 | Allen | 415/66 |
| 2,933,893 | 4/1960 | Blyth et al. | 415/104 |
| 3,658,438 | 4/1972 | Coleman et al. | 248/901 |
| 3,771,499 | 11/1973 | Marroni, Jr. et al. | 248/901 |
| 3,837,164 | 9/1974 | Carr | 415/126 |
| 4,037,983 | 7/1977 | Poeta | 415/66 |

FOREIGN PATENT DOCUMENTS

| | | |
|---|---|---|
| 1216322 | 5/1966 | Fed. Rep. of Germany . |
| 784655 | 7/1935 | France . |
| 516736 | 1/1972 | Switzerland . |
| 1145612 | 3/1969 | United Kingdom . |

OTHER PUBLICATIONS

European Patent No. 56,171 Jul. 1982.

*Primary Examiner*—John T. Kwon

*Attorney, Agent, or Firm*—Burns, Doane, Swecker & Mathis

[57] ABSTRACT

In order to compensate for the axial displacements of the rotors of steam turbines occurring in operation by simultaneous displacement of the inner casing (11, 12) and, by this means, to keep the axial clearance between the stator and rotor blading rows constant, the inner casing (11, 12) of a double-casing turbine is supported in its outer casing (9, 10) so that it can be displaced relative to it. Lever pairs (18, 19), each having a two-arm displacement lever (20, 27), which is supported on bearing blocks (21, 28) fixed relative to the outer casing, and an expansion lever (22, 29) interacting with it are used for the displacement. An extension ($\Delta l$), occurring due to the operational heating in a section of length (l) of the inner casing (11, 12), between two bearing trunnions (23, 26) is transmitted by the expansion levers (22, 29) to the displacement lever (20, 27), whose pivoting about the bearing trunnion (26) in the clockwise direction achieves the necessary displacement ($\Delta x$, $\Delta x2$).

1 Claim, 2 Drawing Sheets d
l
Δl
Δα1
α1
Δα2
σ1
σ2
a1
b1
a2
b2
1
2
3
4
5
6
7
8
9
10
11
12
13
14
15
16
17
18
19
x1
x2
A d
l
a
b
Δl
Δx
α
σ
9
10
11
12
18
19
20
21
22
23
24
25
26
27
28
29
4
$d_1$
$d_2$
$a_1$
$a_2$
$b_1$
$b_2$
$l+\Delta l$
$\Delta x_1$
$\Delta x_2$
$x_1$
$x_2$
x
A
II
III

MULTI-CYLINDER STEAM TURBINE SET

BACKGROUND OF THE INVENTION

The present invention concerns a multi-cylinder steam turbine set with a high pressure partial turbine, a medium pressure partial turbine and at least one low pressure partial turbine, which low pressure partial turbines have a double casing design with an outer casing each and an inner casing each supported within the outer casing and supported so that it can be displaced relative to it, the rotors of all the partial turbines being seated on common shafting which is axially located in both directions at a thrust bearing located between the medium pressure partial turbine and the high pressure partial turbine, and having elements to compensate for the axial displacements of the rotors relative to their inner casings occurring in operation due to the thermal expansions.

FIELD OF THE INVENTION

In the case of multi-cylinder turbines which have a medium pressure partial turbine and at least one low pressure partial turbine in addition to a high pressure partial turbine, measures have to be provided to ensure that the minimum axial clearances necessary between adjacent rotor and stator blading rings are maintained during operation. In such turbines, in which the partial turbines are designed as double-casing turbines with an inner and outer casing, such measures generally consist of connecting links between the inner casing of the medium pressure turbine and the inner casing of the subsequent low pressure turbine and between its inner casing and the inner casing of a possible further low pressure turbine and so on, if still further low pressure partial turbines should be present. Something in the nature of a bearing position is then designed as a fixed point between the high pressure partial turbine, referred to in what follows as "high pressure part" for short and the medium pressure partial turbine, referred to in what follows as "medium pressure part" for short, from which fixed point the high pressure part and the medium pressure part with the subsequent low pressure parts can expand unhindered in opposite directions.

DISCUSSION OF BACKGROUND

A multi-cylinder turbine with such a concept to compensate for changes in axial clearance due to thermal expansions is described in German Patent Specification 1,216,322 by Rateau. In this, a single-casing medium pressure part, which carries out the displacements due to thermal expansions jointly with its turbine rotor, transmits these expansions via coupling rods (which extend into the outer casing of the two casing design of the low pressure part) to the inner casing on which the rods are hinged. The shaft with the turbine rotor is displaced, because the temperature is substantially equal to that of the inner casing, by the same amount as the inner casing and its blading so that the axial clearances between the stator and rotor blading rings remain of practically the same magnitude as in the cold condition. The fixed point of the shaft—from which, on the one hand, the medium pressure part together with its connected inner casings of the low pressure parts and, on the other hand, in the opposite direction, the high pressure part can expand freely and be displaced—is located at a bearing position between the high pressure part and the medium pressure part.

A difficulty in this design is provided by the seals at the coupling rod penetration points on the outer casings of the low pressure parts. In the patent mentioned, corrugated tubes or bellows or stuffing boxes or the like are proposed for this purpose but all of these represent a possible fault source.

The present invention arose from the object of avoiding the sealing problems mentioned in a multi-cylinder steam turbine and to make the device for maintaining the axial clearances between the stator and rotor blading rings of the low pressure parts as simple, uncomplicated and reliable as possible.

SUMMARY OF THE INVENTION

Accordingly, one object of this invention is to maintain, in a multi-cylinder turbine set, the axial clearances between the stator blading and the rotor blading of the partial turbines at operating temperature by providing on each side of the inner casing a lever pair having a two-arm displacement lever and a single-arm expansion lever hinged on the displacement lever by means of a pin, the other end of the displacement lever being hinged on a bearing block fixed relative to the outer casing and the other end of the expansion lever being hinged on a bearing trunnion fixed relative to the inner casing, and by the displacement lever engaging between its hinge points on the bearing block and on the expansion lever by means of an elongated hole with a bearing trunnion fixed relative to the inner casing, the axis of this bearing trunnion subdividing the displacement lever into its lever arms, thus generating a displacement $\Delta x$, by means of the expansion lever and the displacement lever, of the inner casing relative to the bearing blocks fixed relative to the outer casing by means of an extension $\Delta l$, caused by the thermal expansion occuring in operation, of the distance between the two bearing trunnions fixed relative to the inner casings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 5, 6:
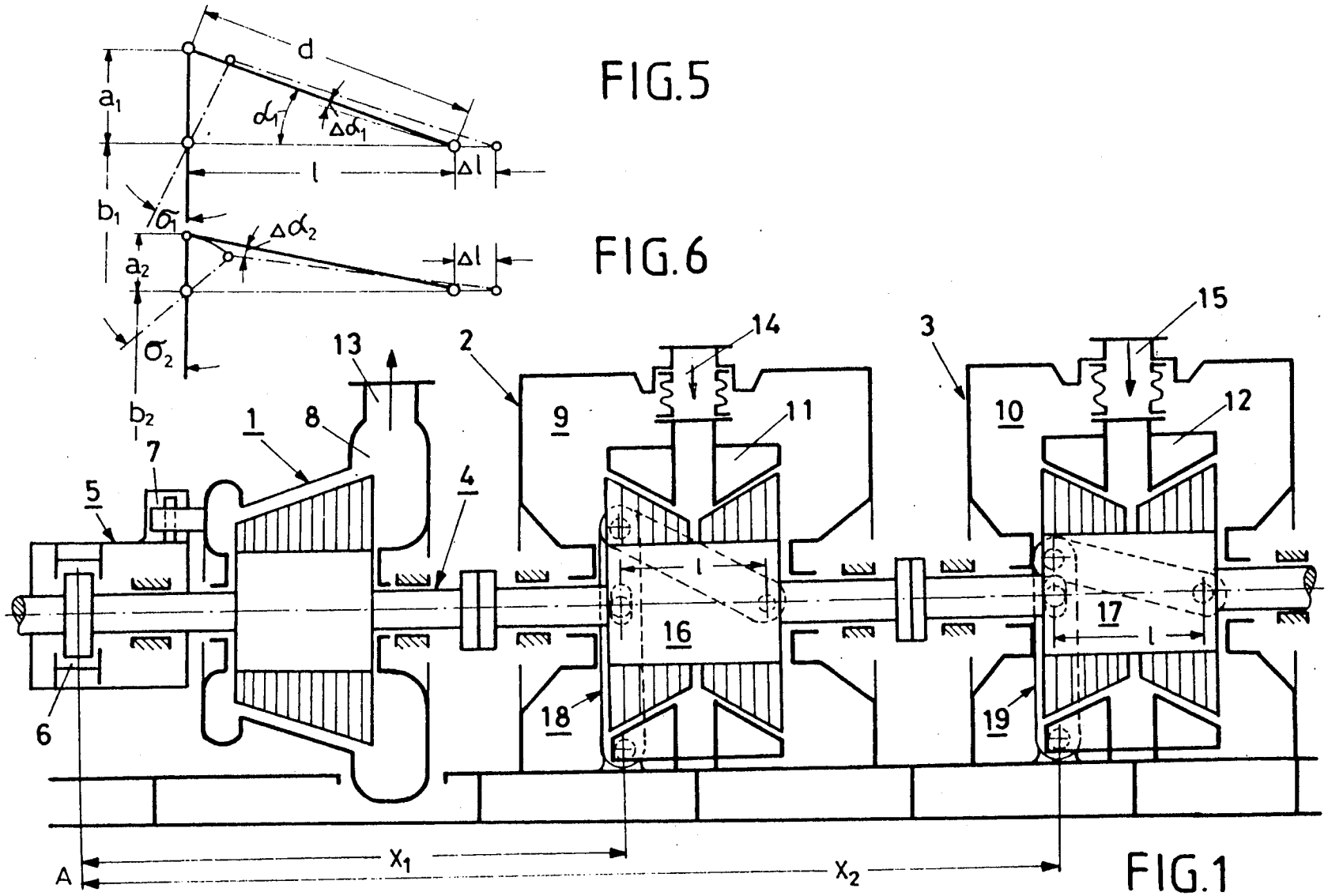
FIG. 1 shows an axial longitudinal section through a medium pressure and two low pressure partial turbines of the steam turbine installation.
FIGS. 4 to 6 show sketches explaining the kinematic relationships between the elements of the adjustment arrangements for the inner casing.

Referring now to the drawings, wherein like reference numerals designate identical or corresponding parts throughout the several views, FIG. 1 shows a medium pressure partial turbine 1, whose high pressure partial turbine, located to the left of it and not shown, and two or possibly more low pressure turbines 2 and 3 supply their power, via common shafting 4, to an electrical generator (not shown) connected to the right-hand end of the shafting. The shafting 4 is fixed in both directions by a double-sided thrust bearing 6 in a bearing housing 5 located between the high pressure part and the medium pressure part 1. From this fixed point, the high pressure part (not shown) can expand unhindered towards the left because its casing is supported, in known manner, by lug supports on slide rails so that it can be displaced, tipping about the shaft axis due to the reaction torque being prevented by a support which forms an axial mounting feature of the central casing. The figure shows such a support 7 for the casing 8 of the medium pressure part 1. The casing 8 and the bearing housing 5 are permanently connected together axially.

The outer casings 9 and 10 of the low pressure parts 2 and 3 are fastened to the base plate and their inner casings 11 and 12 are secured in the relevant outer casing in known manner against tipping and so that they can be displaced axially relative to the relevant outer casing. The steam outlet pipe on the medium pressure partial turbine 1 is indicated by 13 and the two steam supply pipes to the low pressure turbines 2 and 3 are indicated by 14 and 15.

The simplification of the invention relative to the state of the art mentioned at the beginning consists in the fact that instead of coupling rods or other rigid transmission elements between the individual partial turbines, a lever system is used which achieves the displacements of the inner casings in the operating condition of the turbine, these displacements being necessary to compensate for the displacements of the rotors seated on the shafting and thus to maintain the axial clearances between the stator and rotor bladings of the partial turbines.

In each partial turbine, this lever system includes a lever pair on each side of the relevant inner casing, one hinge point of which lever pair has a fixed location on the outer casing whereas two further hinge points for each lever pair are provided at the sides on the lower parts of the displacable inner casing.

The advantages of this concept relative to the known designs described at the beginning, as will be made clear again in the following description mentioned, consist mainly in the fact that the displacement of each individual inner casing takes place individually, independently of the adjacent casing. This displacement then occurs automatically as a function of the temperature occurring in the relevant partial turbine. In addition, the sealing problems of the known designs, described above, disappear because there are no physical connections between the elements of the individual partial turbines causing the displacement and the sealing devices mentioned are therefore unnecessary.

Figures 2, 3, 4:
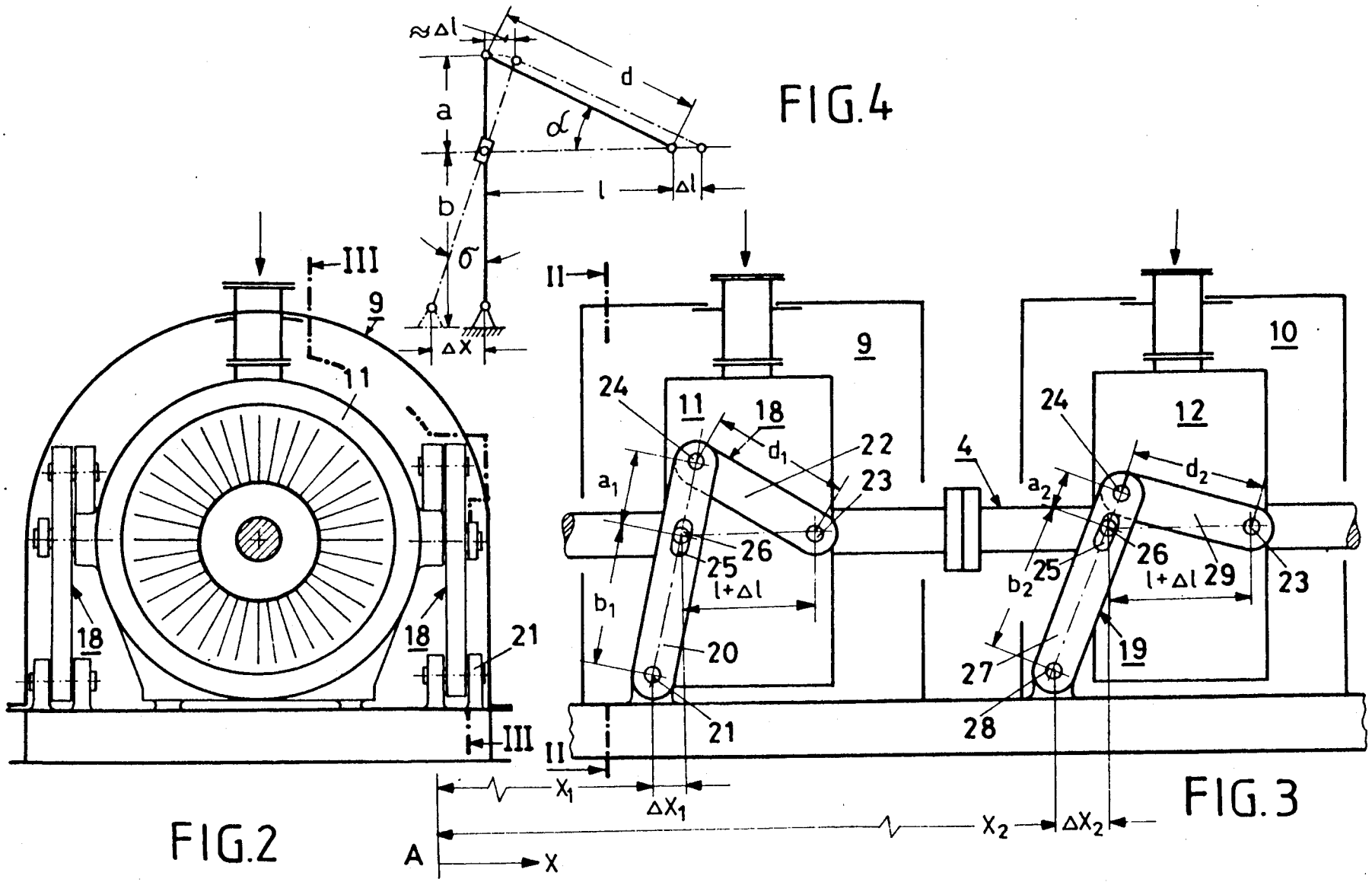
FIGS. 2 and 3 show a cross-section and a longitudinal section through the two low pressure partial turbines of FIG. 1 corresponding to the section lines III—III and II—II.

The lever system is now described in more detail using FIGS. 1-3. The vertical axial section shown in FIG. 1 shows three partial turbines of a steam turbine generator set, i.e. the medium pressure partial turbine 1, to which is connected on the left a high pressure partial turbine (not shown) and the two low pressure partial turbines 2 and 3 which are, generally speaking, followed on the right by an electrical generator (not shown). In FIG. 1, the lever pairs 18 forming the lever system for the temperature-dependent displacement are, for simplicity, only shown in the two low pressure parts 2 and 3. In principle, they can also be used in a similar manner for all the other partial turbines which may be present in a multi-cylinder steam turbine generator set.

The lever pairs, indicated by 18 and 19, are shown in FIG. 1 in their position with the installation cold and at rest. Of the two lever pairs 18, 19 provided for each low pressure part, only the rear and mainly covered pair are shown in the representation of FIG. 1. They are therefore drawn as interrupted lines. Their arrangement can be seen more clearly in FIGS. 2 and 3, which are even further simpified relative to FIG. 1.

FIG. 2 corresponds to the section line II—II drawn in FIG. 3. The spatial arrangement of the lever pair 18 from FIG. 3 can be seen. The same arrangement also applies to the lever pair 19 which, however, differs from the pair 18 in the lever dimensions corresponding to the displacement path of the inner casing 12 necessary relative to the inner casing 11. The lever pairs 18 each consist of a long two-arm lever 20, referred to below as the displacement lever and having lever arms a and b, pivotably supported at its one end in a bearing block 21 permanently connected to the outer casing or the foundation and a shorter, single-arm lever 22, referred to below as the expansion lever. The latter is supported at one of its ends on a bearing trunnion 23 fixed relative to the casing at the height of the shaft axis. The two other ends of the two levers 20 and 22 are pivotably connected together by a pin 24. The displacement lever 20 also has a hole 25, which is elongated for kinematic reasons, at the level of the shaft axis; a further bearing trunnion 26 fixed relative to the inner casing and at the height of the shaft axis engages in this hole. In practice, a crosshead is, of course, provided in the elongated hole 25 to accept such a trunnion 26.

The lengths $x_1$, and $x_2$ are the distances of the bearing blocks 21 and 28 (fixed relative to the foundation) of the displacement levers 20 and 27 from the position A, the initial point for the axial displacements of the turbine rotors seated on the shaft 4. The lever arms $a_1$, $b_1$ and $a_2$, $b_2$ of the displacement lever 20 (for the lever pair 18) and 27 (for the lever pair 19) are determined from the displacements $\Delta x_1$ and $\Delta x_2$ of the inner casings 11 and 12, where $\Delta x_2 > \Delta x_2$, necessary for the hot turbine relative to their initial positions when the installation is cold and from the given distance 1 between the two bearing trunnions 23 and 26 fixed relative to the inner casing. The distance 1 between the bearing trunnion 23 and 26 on the inner casing should be as large as the length of the inner casing permits. The length d of the expansion lever can be freely selected within the limits of the length of the inner casing. In FIG. 3, the expansion lever 22 of the lever pair 18 is longer than that, 29, of the lever pair 19, which has to deal with a larger displacement of the lever pair associated with it.

The relationship between the thermal expansion $\Delta l$ of an inner casing between its two hinge points of the expansion lever and of the displacement lever and the displacement $\Delta x$ necessary to maintain the specified axial clearances between the sets of blading is apparent from FIG. 4. In this, the displacement of the link 11 or 24, which connects the upper arm a of the displacement lever to the expansion lever, and is indicated as being approximately equal to $\Delta l$ in FIG. 4 can be assumed as being equal to $\Delta l$ because of the generally small angle $\alpha$ between the expansion levers 22 and 29 and the horizontal. The change $\Delta\alpha$ in $\alpha$, see FIGS. 5 and 6, can also be neglected because of its trivial effect on the pivoting of the displacement lever. With these assumptions, $\Delta X = f(l, a, b)$ can be taken to be $\Delta X/\Delta l \approx b/a$ and hence $\Delta X \approx (b/a)\,\Delta l$ from the proportionality of the lever arms a, b and from the circular arcs described by their end points when pivoting by the angle $\alpha$.

For a particular example where $l=25{,}000$ mm, $a=500$ mm, $b=1{,}000$ mm and $\Delta l=10$ mm, there is a displacement of the inner casing by 20 mm. The angle $\alpha$ is then approximately 11°. Given knowledge of the thermal expansion $\Delta l$, any desired displacements $\Delta x$ of the inner casing can be achieved by an appropriate choice of the arms a and b of the displacement lever.

FIGS. 5 and 6 show the effect of the magnitude of the angle $\alpha$, which depends on a and l, on the displacement angle $\alpha$ by which the displacement lever pivots when $\Delta l$ appears. As $\alpha$ is chosen smaller, $\delta$ becomes larger and, for a given b, the displacement $\Delta x$ becomes greater but for a given displacement resistance, on the other hand, the hindrance dependent on this to the thermal expansion $\Delta l$ of the distance l between the hinge points 23 and 26 on the inner casing also becomes greater. In order to avoid the associated stresses, the angle $\alpha$, i.e. the ratio a/l and also a/b, should not be made too small. Furthermore, low-friction intermediate layers or coatings should also be provided in order to minimize the adjustment forces on the sliding surfaces of the supports of the inner casing. The adjustment forces can also be kept small by the use of rocking supports involving very small changes in height during the rocking motion.

The above principle of deriving a displacement of desired magnitude of a thermally loaded casing relative to another component and dependent on the thermal change in length of a dimension of this casing itself can also be applied to other cases in which thermal expansions adversely affect the function of a machine or prevent it.

Another possibility of applying this principle to thermal machines with high working temperatures, but one which is more difficult to execute, is offered by mutually communicating hydraulic cylinders with piston diameters of different magnitudes corresponding to the transmission ratio $\Delta l/\Delta x$. A hydraulic cylinder clamped between the end points of the reference length l transmits the displacement $\Delta l$ of its piston hydrostatically to a hydraulic cylinder which displaces the component to be displaced relative to another by $\Delta x$.

A coupling between $\Delta l$ and $\Delta x$ is also conceivable by using electrical or magnetic parameters whose values are altered by $\Delta l$ and are used to actuate an electrical or electro-hydraulic servo-device for generating the displacement $\Delta x$.

The hinge points 23 and 26 on the inner casing for the expansion lever and the center of rotation of the displacement lever will normally be provided in a horizontal plane on the inner casing lower part. If this is impossible or impractical for any reasons, these hinge points can also be provided on the inner casing upper part of with one of them on the lower part and one on the upper part so that they lie on an inclined plane.

Obviously, numerous modifications and variations of the present invention are possible in light of the above teachings. It is therefore to be understood that within the scope of the appended claims, the invention may be practiced otherwise than as specifically described herein.

what is claimed as new and desired to be secured by Letters Patent of the United States is:

1. A multi-cylinder steam turbine set with a high pressure partial turbine, a medium pressure partial turbine (1) and at least one low pressure partial turbine (2, 3), which low pressure partial turbines have a double casing design with an outer casing (9, 10) each and an inner casing (11, 12) each supported within the outer casing and supported so that it can be displaced relative to it, the rotors (16, 17) of all the partial turbines (1, 2, 3) being seated on common shafting (4) which is axially located in both directions at a thrust bearing (6) located between the medium pressure partial turbine (1) and the high pressure partial turbine, wherein a lever pair (18, 19) is provided on each side of the inner casing (11, 12) to maintain the axial clearances between the stator blading and the rotor blading of the partial turbines (2, 3) at operating temperature, the lever pair having a two-arm displacement lever (20, 27) and a single-arm expansion lever (22, 29) hinged on the displacement lever by means of a pin (24), the other end of the displacement lever (20, 27) being hinged on a bearing block (21, 28) fixed relative to the outer casing and the other end of the expansion lever (22, 29) being hinged on a bearing trunnion (23) fixed relative to the inner casing, ann wherein the displacement lever (20, 27) engages between its hinge points on the bearing block (21, 28) and on the expansion lever (22) by means of an elongated hole (25) with a bearing trunnion (26) fixed relative to the inner casing, the axis of this bearing trunnion subdividing the displacement lever into its lever arms (a, b), thus generating a displacement $\Delta x$, by means of the expansion lever (22, 29) and the displacement lever (20, 27), of the inner casing (11, 12) relative to the bearing blocks (21, 28) fixed relative to the outer casing by means of an extension $\Delta l$, caused by the thermal expansion occurring in operation, of the distance (1) between the two bearing trunnions (23, 26) fixed relative to the inner casings.

* * * * *